US006183069B1

(12) United States Patent
Burke et al.

(10) Patent No.: US 6,183,069 B1
(45) **Date of Patent: *Feb. 6, 2001**

(54) INK JET PRINTHEAD HAVING A PATTERNABLE INK CHANNEL STRUCTURE

(75) Inventors: Cathie J. Burke, Rochester; Mildred Calistri-Yeh; Diane Atkinson, both of Webster; Almon P. Fisher, Rochester, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/004,765

(22) Filed: Jan. 8, 1998

(51) Int. Cl.[7] ..... B41J 2/05
(52) U.S. Cl. ..... 347/65; 347/85
(58) Field of Search ..... 347/65, 63, 85

(56) References Cited

U.S. PATENT DOCUMENTS

| | | | |
|---|---|---|---|
| Re. 32,572 | 1/1988 | Hawkins et al. | 156/626 |
| 4,774,530 | 9/1988 | Hawkins | 346/140 |
| 4,947,192 | 8/1990 | Hawkins et al. | 346/140 |
| 4,947,193 | 8/1990 | Deshpande | 346/140 |
| 5,132,707 | 7/1992 | O'Neill | 346/140 |
| 5,198,834 | 3/1993 | Childers et al. | 346/1.1 |
| 5,665,249 | 9/1997 | Burke et al. | 216/2 |
| 5,686,224 | 11/1997 | O'Neill | 430/320 |
| 5,699,094 | 12/1997 | Burke et al. | 347/63 |
| 5,738,799 * | 4/1998 | Hawkins et al. | 216/27 |
| 5,820,771 * | 10/1998 | Burke et al. | 216/27 |
| 5,850,234 * | 12/1998 | Kneezel et al. | 347/18 |
| 5,870,123 | 2/1999 | Lorenze, Jr. et al. | 347/65 |

FOREIGN PATENT DOCUMENTS 0 768 182 A2 4/1997 (EP) .

* cited by examiner

*Primary Examiner*—Richard Moses
(74) *Attorney, Agent, or Firm*—David J. Arthur

(57) ABSTRACT

An ink jet printhead is disclosed which has a heater plate containing the heating elements and driving circuitry means monolithographically formed on one surface thereof and the ink flow directing channel structure is formed on the heater plate using a layer of patternable material, so that all critical alignments are done directly on the heater plate. In one embodiment, the patternable material is a photosensitive polymer which is exposed using a mask to define the channel and reservoir pattern, which is then developed and cured. After curing, the patterned channel structure is polished to provide a smooth coplanar surface and a cover plate with an aperture therein is aligned with a loose tolerance to the channel structure and bonded thereto to complete the printhead. The aperture serves as both ink inlet and a portion of the ink reservoir. The channels are open at one end and serve as the droplet ejecting nozzles, while the other ends are connected to the reservoir. In one embodiment, the cover plate is transparent and the channel structure material is polyimide or polyarylene ether ketone.

14 Claims, 5 Drawing Sheets

INK JET PRINTHEAD HAVING A PATTERNABLE INK CHANNEL STRUCTURE

BACKGROUND OF THE INVENTION

This invention relates to ink jet printing devices and more particularly to thermal ink jet printheads having a patternable ink flow directing channel structure.

In one conventional thermal ink jet printhead, the printhead consists of two sections, a heater plate and a channel plate. Some geometrical features are formed in both plates in such a way that, when bonded together, they form the desired configuration for ink droplet ejection. For example, U.S. Pat. No. 4,774,530 discloses a printhead in which upper and lower silicon substrates are mated and bonded together with a thick film insulative layer sandwiched therebetween. One surface of the upper substrate or channel plate has a plurality of parallel grooves and a recess etched therein. When mated with the lower substrate or heater plate, the grooves and recess form the printhead ink channels and ink reservoir, respectively. The grooves are open at one end and closed at the other end. The channel open ends serve as the printhead nozzles. The channel closed ends are closely adjacent the reservoir and placed in fluid communication therewith by a patterned recess in the thick film layer. Each channel is capillarily filled with ink from the reservoir and has a heating element located upstream of the nozzles. Each heating element is selectively driven by electrical pulses representative of data signals to produce momentary vapor bubbles in the ink to effect the ejection of ink droplets from the printhead nozzles and propel them to a recording medium. The thick film layer is also patterned to expose the heating elements and thereby place the heating elements in a pit to better contain the vapor bubble and prevent ingestion of air.

This printhead construction has some drawbacks. For example, the silicon channel plate is anisotropically or orientation dependent etched to form straight, triangularly shaped grooves when non-straight grooves provides more design flexibility and non-triangular shaped nozzles assist in droplet directionality. In addition, an etched silicon channel plate means separate fabrication of the two plates and the necessity of very accurate alignment between the two when they are mated. Because silicon is opaque, it is difficult to determine if the adhesive is coating all of the surface areas required to separate the channels and to prevent internal ink leaks.

U.S. Pat. No. 5,132,707 discloses a thermal ink jet printhead having an array of coplanar nozzles in a nozzle face that are entirely surrounded by a polymeric material. The ink channels, nozzles, and ink reservoir are produced by sequentially depositing and patterning two layers of polymeric material, such as, for example, Vacrel®, on the heater plate, so that the heating elements are placed in a pit in the first layer and the channels and reservoir recesses are produced in the overlying second layer. The cover plate has a third layer of identical polymeric material with a hole through both the cover plate and third layer to serve as the ink inlet. The cover plate with the third layer is aligned and bonded to the second layer with the cover plate hole aligned with the reservoir recess in the second layer to produce the printhead.

U.S. Pat. No. 5,198,834 discloses a printhead or pen head for a droplet-on- demand ink jet printer or pen which utilizes a barrier wall located between a substrate and an orifice plate. The ink flows through the printhead in channels defined in the barrier wall. The barrier wall is fabricated in two layers from cured, photoimaged resist materials. One layer is a soldermask material, and the other is a photolithographic resist material. The two layers together resist chemical attack by the ink and separation of the orifice plate from the printhead.

Pending U.S. patent application Ser. No. 08/712,761, filed Sep. 12, 1996, entitled "Method and Materials For Fabricating An Ink Jet Printhead," and assigned to the same assignee as the present invention discloses an ink jet fabrication technique which enables capillary channels for liquid ink to be formed with square or rectangular cross-sections. A sacrificial layer is placed over the main surface of a silicon chip, the sacrificial layer being patterned in the form of the void formed by the desired ink channels. A permanent layer comprising a permanent material is applied over the sacrificial layer and, after polishing the two layers to form a uniform layer which exposes some of the surfaces of the sacrificial layer, the sacrificial layer is removed to form open ink channels. A cover plate is bonded to the patterned permanent material to provide the closed ink channels and produce the printhead. Preferred sacrificial layer materials include polyimide while the preferred permanent layer materials include polyarylene ether ketone.

SUMMARY OF THE INVENTION

It is an object of the invention to provide an ink jet printhead having a patternable ink channel structure which is formed directly on the heater plate, so that all of the critical alignments are done on the heater plate without the need for straight channels or separate channel plate.

In one aspect of the present invention, there is provided an ink jet printhead having a patternable ink channel structure comprising: a heater plate having on one surface thereof an array of heating elements, driving circuitry means, and interconnecting leads including contacts for the selective application of electrical pulses to each of the heating elements, each of the selectively applied pulses ejecting an ink droplet from the printhead; a passivation layer covering the heater plate surface and the addressing circuitry means and interconnecting leads thereon, the heating elements and contacts being free of the passivation layer; a patternable layer being deposited on the passivation layer and patterned to expose the contacts and to form a plurality of parallel channel grooves therein with opposing ends, each channel groove containing and exposing therein a heating element, one end of the channel grooves being open and each of the opposing ends being connected to a reservoir recess; and a cover plate having an aperture and being bonded to the patternable layer to form the ink channels from the channel grooves, a common reservoir from the reservoir recess, and nozzles from the channel open ends, the aperture in the cover plate being aligned with the common reservoir to provide an ink inlet for the printhead.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
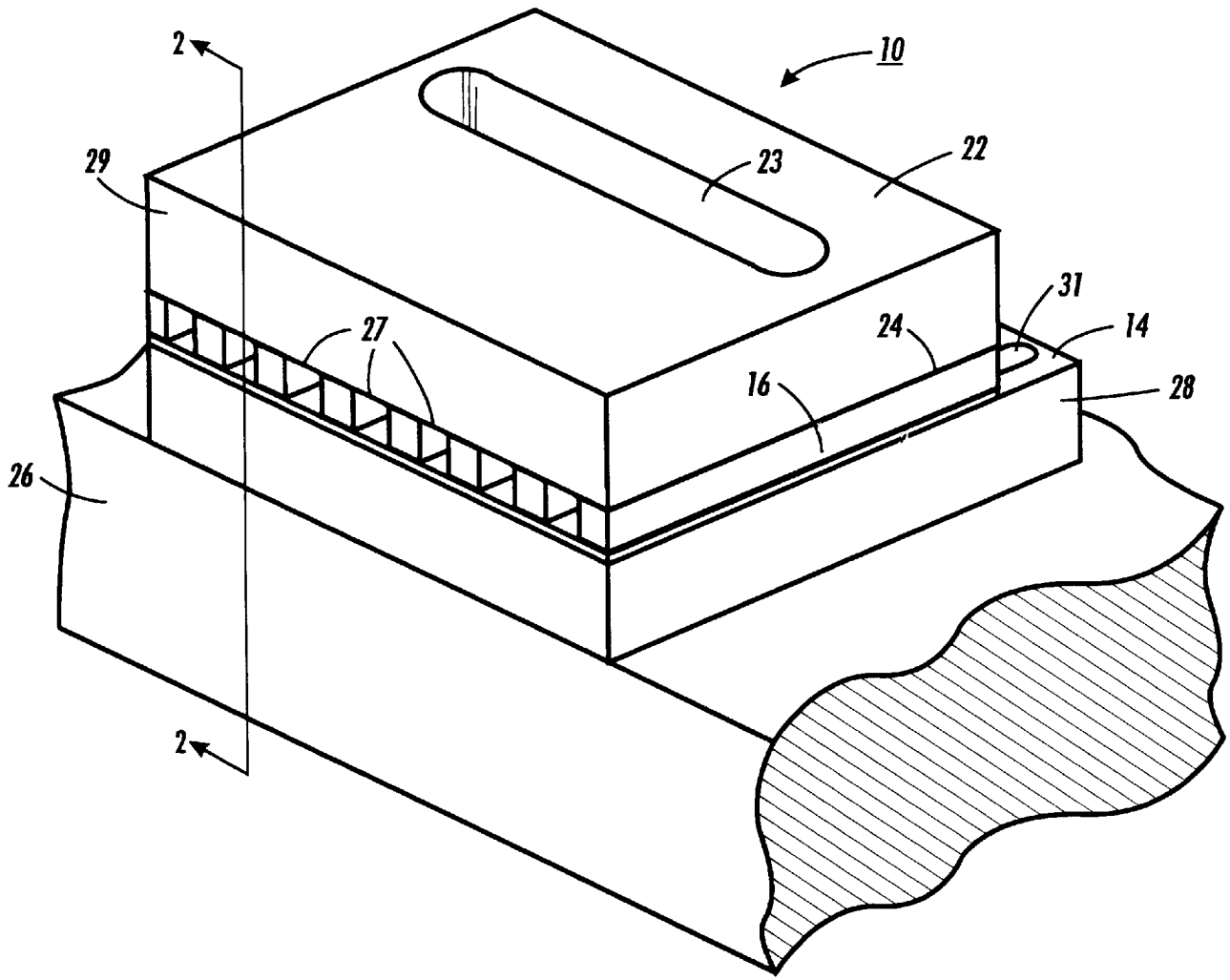
FIG. 1 is a schematic isometric view of a printhead in accordance with the present invention and oriented so that the droplet ejecting nozzles are shown.
Figure 2:
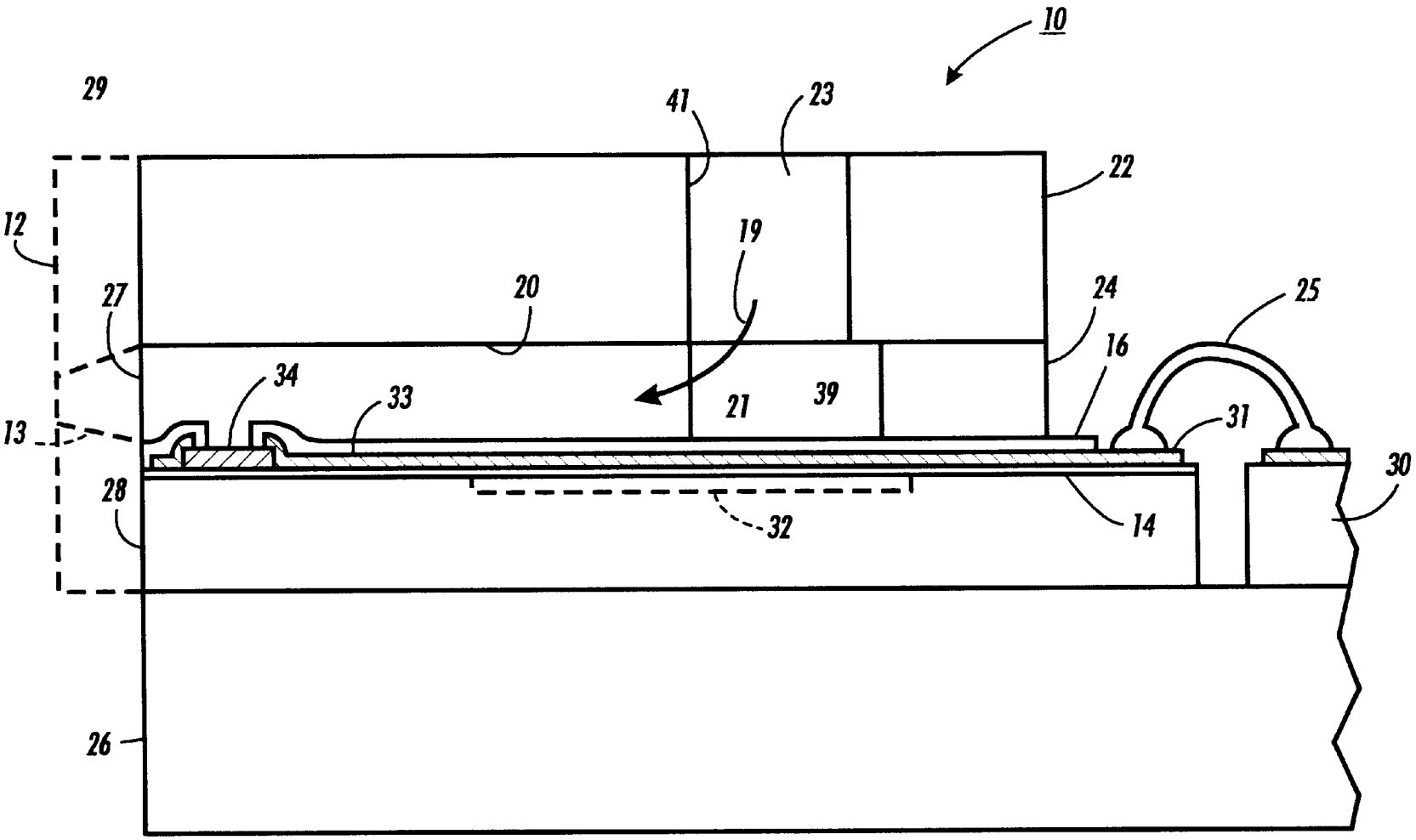
FIG. 2 is a cross-sectional view of FIG. 1 as viewed along the view line 2—2 thereof.

In FIG. 1, a schematic isometric view of an ink jet printhead 10 in accordance with the present invention is shown mounted on a heat sink 26 and oriented to show the front face 29 of printhead and the array of droplet ejecting nozzles 27 therein. Referring also to FIG. 2, a cross-sectional view of FIG. 1 taken along view line 2—2 through one ink channel 20, the silicon heater plate 28 has the heating elements 34, driving circuitry means 32 represented by dashed line, and leads 33 interconnecting the heating elements and driving circuitry means and having contacts 31 connected to a printed circuit board 30 by wire bonds 25. The circuit board is connected to a controller or microprocessor of the printer (neither shown) for selectively applying a current pulse to the heating elements to eject ink droplets from the nozzles. One suitable driving circuitry means is described in U.S. Pat. No. 4,947,192 and is hereby incorporated by reference. Generally, an underglaze layer 14 is formed on the heater plate surface on which the heating elements, driving circuitry means, and leads are to be formed, followed by a passivation layer 16 which is patterned to expose the heating elements and contacts.

A patternable material is deposited over the heater plate to form the patternable layer 24, which layer 24 is patterned by any suitable means, such as, for example, wet or dry etching, including reaction ion etching (RIE) and photolithography, to produce ink reservoir portion 39 and the ink channels 20 therein. The channels have open ends to serve as nozzles 27 and ends 21 which connect to the reservoir portion 39. The patternable layer is also patterned to expose the contacts 31 of the electrical leads. In the preferred embodiment, the patternable material is a photosensitive polymeric material which is photolithographically patterned, and hereinafter the invention will be described using a photosensitive polymer layer 24. If the surface of the patterned and then cured polymer layer 24 is uneven, the surface thereof is polished by any suitable process, such as, for example, that disclosed in U.S. Pat. No. 5,665,249 incorporated herein by reference. Such a polishing process provides a smooth and level surface for the cover plate. A cover plate 22 may be any material which is not attacked by the ink, such as, glass, quartz, plastic, silicon, metal, polymeric, or ceramic material. The cover plate 22 has an aperture 23 therethrough, and is bonded to the surface of the patterned photopolymer layer 24 with a suitable adhesive 18 (see FIG. 6). The cover plate aperture 23 has a size suitable to prevent impeding channel refill and to provide an adequate ink supply reservoir for the printhead, when combined with the reservoir portion 39 in the photopolymer layer 24. The ink flow path from the reservoir to the channels 20 is indicated by arrow 19. An optional nozzle plate 12 is shown in dashed line which is adhered to the printhead front face 29 with the nozzles 13 therein aligned with the open ends 27 of the channels 20 in the photopolymer layer 24.

As disclosed in U.S. Pat. No. Re. 32,572, U.S. Pat. Nos. 4,774,530, and 4,947,192 all of which are incorporated herein by reference, the heater plates of the present invention are batch produced on a silicon wafer (not shown) and later separated into individual heater plates 28 as one piece of the printhead 10. As disclosed in these patents, a plurality of sets of heating elements 34, driving circuitry means 32, and electrical leads 33 are patterned on a polished surface of a (100) silicon wafer which has first been coated with an underglaze layer 14, such as silicon dioxide having a thickness of about 1–5 $\mu$m. The heating elements may be any well known resistive material such as zirconium boride, but is preferably doped polycrystalline silicon deposited, for example, by chemical vapor deposition (CVD) and concurrently monolithically fabricated with the addressing circuitry means as disclosed in U.S. Pat. No. 4,947,193. Afterwards, the wafer is cleaned and re- oxidized to form a silicon dioxide layer (not shown) over the wafer including the addressing circuitry means. A phosphorous doped glass layer or boron and phosphorous doped glass layer (not shown) is then deposited on the thermally grown silicon dioxide layer and is reflowed at high temperatures to planarize the surface. As is well known, photoresist is applied and patterned to form vias for electrical connections with the heating elements and driving circuitry means and aluminum metallization is applied to form the electrical leads and provide the contacts for wire bonding to the printed circuit board which in turn is connected to the printer controller. Any suitable electrically insulative passivation layer 16, such as, for example, polyimide, polyarylene ether ketone, polybenzoxazole, or bisbenzocyclobutene (BCB), is deposited over the electrical leads to a thickness of about 0.5 to 20 $\mu$m and removed from the heating elements and contacts.

Figure 7:
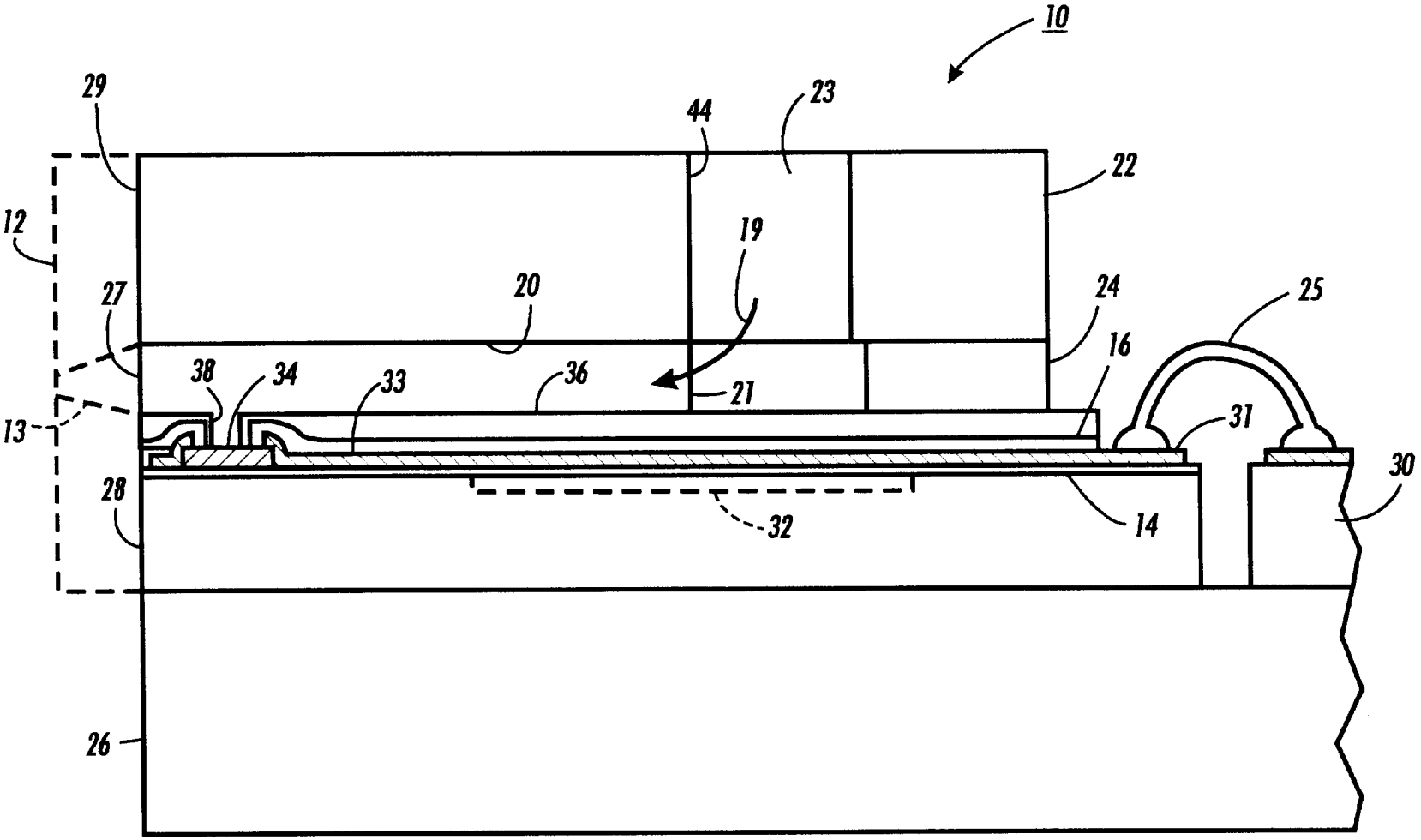
FIG. 7 is a cross-sectional view similar to FIG. 2 showing another embodiment of the present invention.

Next, an optional pit layer 36 of, for example, polyimide or BCB, may be deposited and patterned to provide pits 38 for the heating elements as shown in FIG. 7 and disclosed in U.S. Pat. No. 4,774,530. The optional pit layer 36 is deposited and patterned prior to the deposition of the photopolymer layer 24. However, for high resolution printheads having nozzles spaced for printing at 400 spots per inch (spi) or more, heating element pits have been found not to be necessary, for the vapor bubbles generated to eject ink droplets from nozzles and channels of this size tend not to ingest air.

If the topography of the heater wafer is uneven, the wafer is polished by techniques well known in the industry, such as that disclosed in U.S. Pat. No. 5,665,249 and incorporated herein by reference. Then the photopatternable polymer layer which is to provide the channel structure 24 is deposited. As disclosed in U.S. Pat. No. 5,738,799 filed Sep. 12, 1996, mentioned above, and incorporated herein by reference, a suitable channel structure material must be resistant to ink, exhibit temperature stability, be relatively rigid, and be readily diceable. The most versatile material for a channel structure is polyimide or polyarylene ether ketone (PAEK). In the preferred embodiment, OCG 7520™ polyimide is used, and because polyimide shrinks about 30 to 50% when cured, this must be taken into account when depositing a layer of polyimide on the heating element wafer. After deposition of the polyimide, it is exposed using a mask with the channel pattern, reservoir portion 39 contiguous with the channel ends 21, and contacts pattern. The patterned polyimide channel structure layer 24 is developed and cured. In one embodiment, the channel structure thickness is 30 $\mu$m, so the original thickness deposited is about 65 $\mu$m, which shrinks to about 33 $\mu$m when cured and is then polished to the desired 30 $\mu$m. For the embodiment having a channel structure thickness of 16 μm, the original thickness deposited must be about 40 μm, which shrinks to about 20 μm when cured and is then polished to the desired 16 μm thickness. After the patterned polyimide layer 24 is cured and polished, a cover plate 22, the same size as the wafer and having a plurality of apertures 23 therein, is bonded to the polyimide layer. Each aperture is aligned with reservoir portion 39, and in the preferred embodiment, one elongated side 41 of each of the apertures 23 is aligned with the channel ends 21. The silicon wafer and wafer-size cover plate with the channel structure 24 sandwiched therebetween are separated into a plurality of individual printheads by a dicing operation. The dicing operation not only separates the printheads, but also produces the printhead front face 29 and opens one end of the channels to form the nozzles 27.

Figure 3:
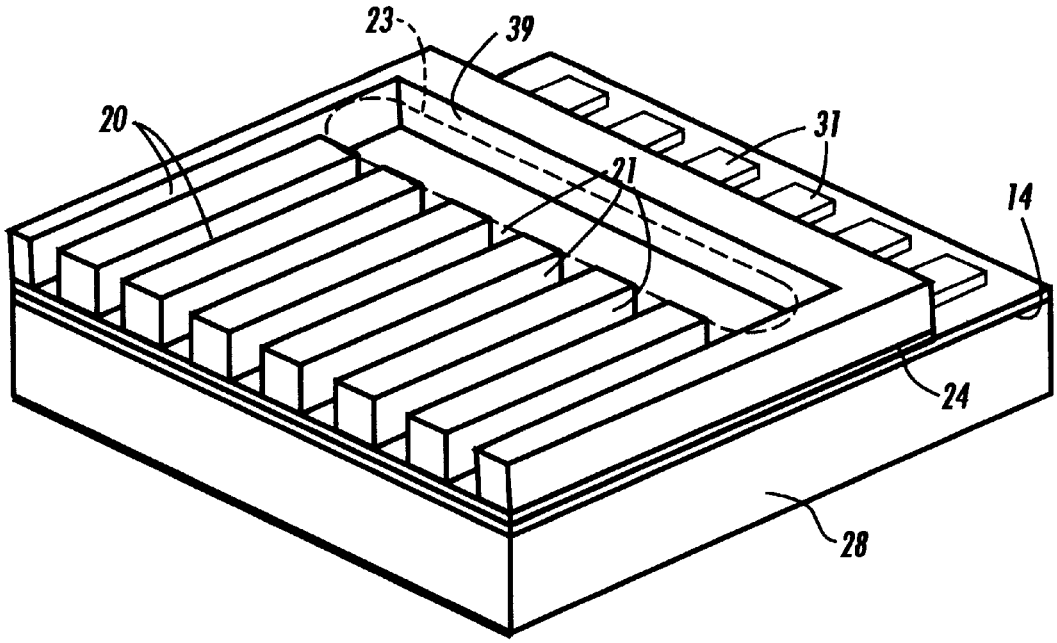
FIG. 3 is a schematic isometric view of the printhead of FIG. 1 without the cover plate.

Referring to FIG. 3, a schematic isometric view of a portion of the heater wafer is shown, comprising a single heater plate 28 having the patterned, cured, and polished polyimide channel structure 24 thereon. The cover plate is omitted, but the aperture 23 therein is shown in dashed line, so that the position of the aperture relative to the reservoir portion 39 and channel ends 21 is identified. This geometry of the reservoir portion 39 and cover plate aperture 23 defines the ink reservoir.

Figure 4:
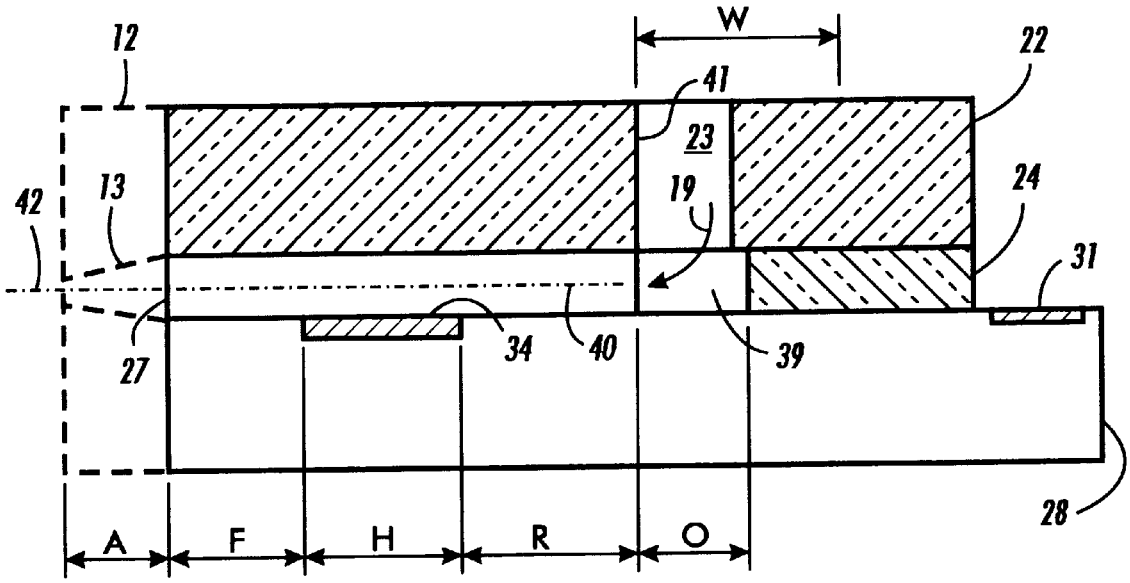
FIG. 4 is a view similar to that of FIG. 2 showing the dimensional spacing between portions of the ink channel.

FIG. 4 is similar to FIG. 2, with the various channel portions identified. For the preferred embodiment of a 600 spi printhead, the cover plate has a thickness of about 125 μm and the aperture is an elongated slot having a length and width sufficient to provide ink during refill which does not impede the flow of ink. Thus the aperture 23 in the preferred embodiment extends across all of the channels and has a width 'W' of 400 to 500 μm. Depending upon the configuration and printing resolution of the printhead 10, the cover plate 22 could have a thickness of between 5 μm and 2 mm, while the aperture 23 may vary in width from 15 μm to 5 mm, where the length of the cover plate aperture generally has a length of about the width of the total array of channels. The thickness of the channel structure 24 of the preferred embodiment is about 30 μm and the channel width is about 30 μm, when the optional nozzle 12 is used, so that a typical channel cross-section is about 30 μm×30 μm. When a 600 spi printhead is used without a nozzle plate 12, the typical channel cross-section is about 16 μm high×30 μm wide. Again, the thickness of the channel structure 24 may vary from 5 to 70 μm and the channels therein may vary in width from 5 to 350 μm, depending upon the printhead configuration and printing resolution. The frequency response is controlled by the rear channel length 'R' which is about 50 μm for the preferred embodiment. The distance 'O' of the reservoir portion 39 is at least 25 μm or greater and in combination with the cover plate aperture 23 forms the printhead reservoir. This distance affects the refill of the channels if this distance is too small, but for sufficiently large distances of 'O' that parameter has no effect on droplet ejection or refill. For the preferred embodiment, a sufficient dimension for 'O' is about 25 μm or greater, as mentioned above. The heating element is about 50–100 μm long ('H') and about 25 μm wide. The heating element is spaced upstream from the nozzle or front face by the dimension 'F' of about 40–90 μm, preferably 50 μm. The optional nozzle plate 12 shown in dashed line is about 5 to 50 μm, preferably 50 μm, and has a conical shaped nozzle 13 for each nozzle 27 in the printhead front face. The conical shaped nozzle is aligned and has its axis 42 substantially coincident with the axis 40 of the channels. The outside opening of the nozzle 13 is about 17 μm in diameter and the inside opening adjacent the nozzle 27 is about 26 μm in diameter.

The geometry of FIG. 4 is very robust against small changes in the geometry, and changes is the channel cross-section and heating element set back dimension F does not affect the droplet volume or droplet velocity. The droplet volume is essentially controlled by the nozzle opening 27 or if a nozzle plate is used then the outside opening of nozzle 13. Because the required droplet volume for black ink is different from non-black colored ink, the desired droplet volume for the different colored inks can be achieved by changing the nozzle sizes in a nozzle plate without changing the rest of the printhead geometry.

Figure 5:
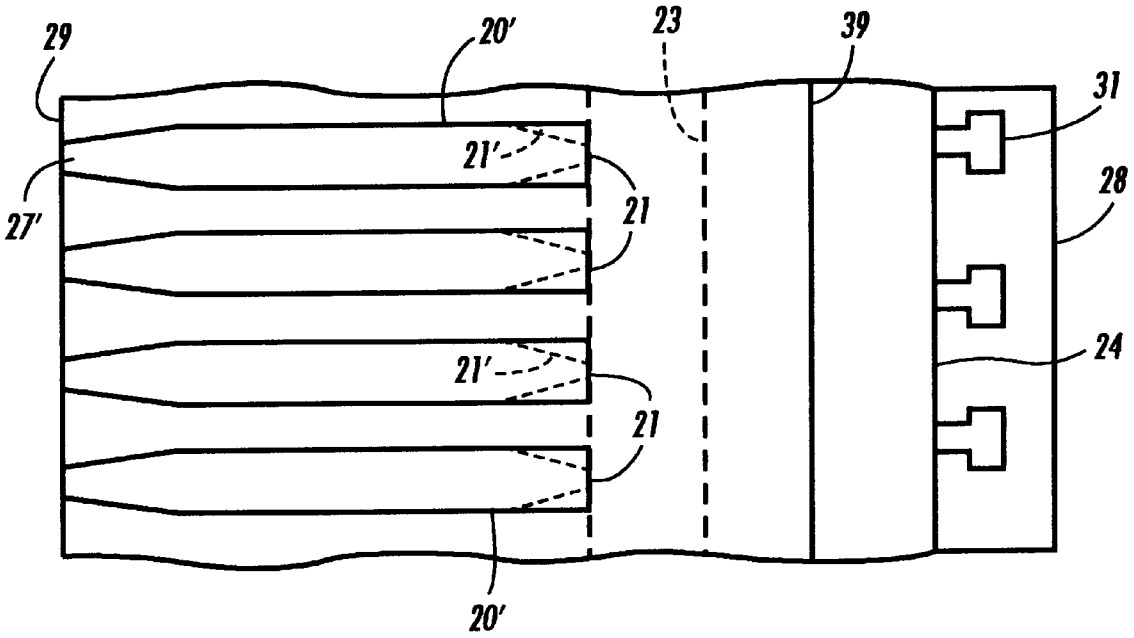
FIG. 5 is a partially shown plan view of an alternate embodiment of the printhead of FIG. 1 without a cover plate showing non-straight ink channels.

FIG. 5 is a partially shown plan view of an alternate embodiment of the printhead shown in FIG. 1 and has its cover plate omitted to show the capability of patterning the channel structure 24 to produce non-straight channels 20'. Thus, the nozzle 27' can be made to have a shape in the printhead front face that is different from the cross-sectional area of the rest of the channels and can simulate the effect of a nozzle plate. Optionally, the channel ends 21 which connect to the reservoir portion 39 may also be tapered to enlarge or reduce the channel entrances as shown in dashed lines 21'.

Figure 6:
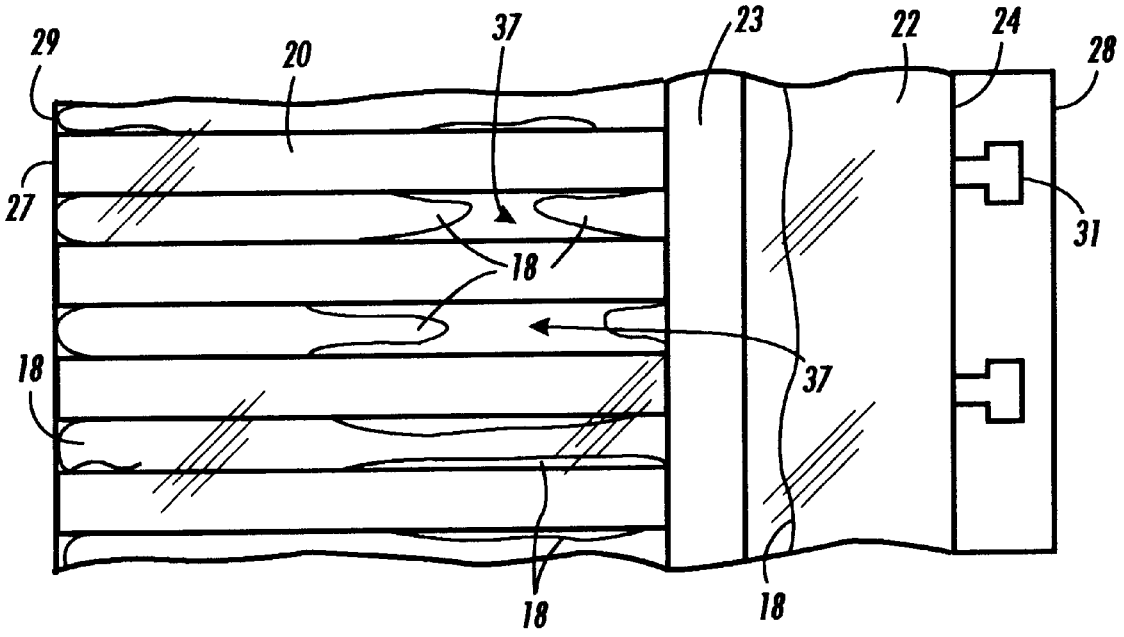
FIG. 6 is a partially shown plan view of FIG. 1 with a transparent cover plate showing the adequacy and integrity of adhesive covering between the surface of the channel structure and the cover plate.

Referring to FIG. 6, a partially shown plan view of the printhead 10 of FIG. 1 is shown with the cover plate 22 being transparent. The advantage of using a transparent cover plate is that the integrity of the adhesive 18 used to bond the cover plate to the channel structure 24 and seal the channels from one another is easy to visually inspect. For example, voids 37 is in the adhesive is clearly apparent through the transparent cover plate. Another benefit of using a transparent cover plate is that any air bubbles (not shown) which may accumulate in the printhead reservoir would be visible upon a cursory visual inspection, so that the printhead could be manually primed to remove the air bubbles before they impacted the print quality of the printer. Although the cover plate 22 of the preferred embodiment is transparent or translucent, an opaque cover plate would function equally as well.

FIG. 7 is a cross-sectional view of the printhead which is similar to that of FIG. 2, but has a pit layer 36 taught by U.S. Pat. No. 4,774,530. The pit layer 36 is considered to be useful for printheads having a resolution of less than 400 spi, but may also be used for higher resolution printheads. Except for the pit layer, the printhead and method of fabrication is same as for the printhead in FIGS. 1 and 2.

Thus, this invention allows all of the critical alignments to be done directly on the heater plate or heater wafer, and the ink inlets is added by bonding a cover plate with aperture 23 in it to patternable channel and reservoir layer 24. It is quite evident that the cover plate aperture alignment is not a critical alignment.

Although the foregoing description illustrates the preferred embodiment, other variations are possible and all such variations as will be apparent to those skilled in the art are intended to be included within the scope of this invention as defined by the following claims.

We claim:

1. An ink jet printhead having an ink reservoir and a patternable ink channel structure, comprising:

a heater plate having on one surface thereof an array of heating elements and interconnecting leads including contacts for the selective application of electrical pulses to each of the heating elements, each of the selectively applied pulses ejecting an ink droplet from the printhead;

a passivation layer covering the heater plate surface and the interconnecting leads thereon, the heating elements and contacts being free of the passivation layer;

a patternable layer deposited on the passivation layer and patterned to expose the contacts and to form a reservoir groove and a plurality of parallel channel grooves therein, each of the plurality of parallel channel grooves having opposing ends and containing and exposing therein a heating element, one end of each of the plurality of parallel channel grooves being open and the opposing end being connected to the reservoir groove; and a cover plate having an aperture, wherein the cover plate is bonded directly to the patternable layer to form a plurality of ink channels from the channel grooves, a reservoir portion from the reservoir groove, and nozzles from the open ends of the plurality of parallel channel grooves, and wherein the aperture in the cover plate is aligned with the reservoir portion to provide an ink inlet and another portion of the ink reservoir.

2. The printhead as claimed in claim 1, wherein the patternable material is a photosensitive polymeric material.

3. The printhead as claimed in claim 2, wherein the photosensitive polymeric material is polyimide.

4. The printhead as claimed in claim 2, wherein the photosensitive polymeric material is polyarylene ether ketone.

5. The printhead as claimed in claim 1, wherein the cover plate is transparent or translucent.

6. The printhead as claimed in claim 1, additionally comprising a nozzle plate having nozzle openings therethrough, wherein the nozzle plate is bonded to the printhead so that the nozzle openings of the nozzle plate are aligned with the open ends of the plurality of parallel channel grooves.

7. The ink jet printhead as claimed in claim 1, wherein:

the patternable layer is a single patternable layer; and the patternable layer is deposited directly on the passivation layer.

8. An ink jet printhead having an ink reservoir and a patternable ink channel structure, comprising:

a heater plate having on one surface thereof an array of heating elements and interconnecting leads including contacts for the selective application of electrical pulses to each of the heating elements, each of the selectively applied pulses ejecting an ink droplet from the printhead;

a passivation layer covering the heater plate surface and the interconnecting leads thereon, the heating elements and contacts being free of the passivation layer;

a single patternable layer deposited directly on the passivation layer and patterned to expose the contacts and to form a reservoir groove and a plurality of parallel channel grooves therein, each of the plurality of parallel channel grooves having opposing ends and containing and exposing therein a heating element, one end of each of the plurality of parallel channel grooves being open and the opposing end being connected to the reservoir groove; and a non-opaque cover plate having an aperture, wherein the cover plate is bonded directly to the patternable layer to form a plurality of ink channels from the channel grooves, a reservoir portion from the reservoir groove, and nozzles from the open ends of the plurality of parallel channel grooves, and wherein the aperture in the cover plate being aligned with the reservoir portion to provide an ink inlet and another portion of the ink reservoir.

9. The printhead as claimed in claim 8, wherein the cover plate is transparent.

10. A method of fabricating an ink jet printhead, comprising the steps of:

(a) providing a heater plate having on a first surface thereof an array of heating elements and interconnecting leads including contacts for the selective application of electrical pulses to each of the heating elements, each of the selectively applied pulses ejecting an ink droplet from the printhead;

(b) depositing on the first surface of the heater plate a passivation layer, so that the heating elements and contacts are free of the passivation layer;

(c) depositing on the passivation layer a patternable layer;

(d) patterning the patternable layer to expose the contacts and to form a reservoir groove and a plurality of parallel channel grooves therein, so that each of the plurality of parallel channel grooves has opposing ends and one of the heating elements exposed therein, one end of each of the plurality of channel grooves being open and the opposing end of each of the plurality of channel grooves being connected to the reservoir groove; and (e) placing and bonding directly onto the patternable layer a cover plate having an aperture therein, with the aperture aligned with the reservoir groove.

11. The method as claimed in claim 10, wherein:

the step of depositing a patternable layer comprises depositing a layer of photosensitive material; and the step of patterning the patternable material comprises exposing and developing the photosensitive material.

12. The method as claimed in claim 10, wherein the step of depositing on the passivation layer a patternable layer comprises depositing the patternable material directly onto the passivation layer.

13. The method as claimed in claim 12, wherein:

the patternable material is a photosensitive material; and the step of patterning the patternable layer comprises photolithography.

14. The method as claimed in claim 10, wherein the cover plate is transparent or translucent.

* * * * *